US005404724A

United States Patent [19]

Silvestri, Jr.

[11] Patent Number: 5,404,724

[45] Date of Patent: Apr. 11, 1995

[54] BOILER FEEDPUMP TURBINE DRIVE/FEEDWATER TRAIN ARRANGEMENT

[75] Inventor: George J. Silvestri, Jr., Winter Park, Fla.

[73] Assignee: Westinghouse Electric Corporation, Pittsburgh, Pa.

[21] Appl. No.: 224,376

[22] Filed: Apr. 7, 1994

[51] Int. Cl.[6] ..... F01K 7/34

[52] U.S. Cl. ..... 60/678; 60/677

[58] Field of Search ..... 60/677, 678

[56] References Cited

U.S. PATENT DOCUMENTS

| | | | |
|---|---|---|---|
| 3,176,267 | 3/1965 | Takeda | 60/678 |
| 4,043,130 | 8/1977 | Brown et al. | 60/678 |

FOREIGN PATENT DOCUMENTS

| | | | |
|---|---|---|---|
| 1029388 | 5/1958 | Germany | 60/678 |
| 345022 | 4/1960 | Switzerland | 60/678 |
| 1012412 | 12/1965 | United Kingdom | 60/678 |

OTHER PUBLICATIONS

Seven Years' Experience With Single Turbine-Driven Feed Pumps Serving Large Generating Units by T. T. Frankenberg and John A. Tillinghast. Presented at American Power Conference, Apr., 1964.

*Primary Examiner*—Ira S. Lazarus
*Assistant Examiner*—L. Heyman

[57] ABSTRACT

An improved cycle arrangement for a steam turbine system in which an auxiliary turbine drives a boiler feedwater pump. The turbine system includes a primary turbine driving an electric power generator. The primary turbine includes a high pressure section and a low pressure section. A boiler supplies steam to drive the primary and auxiliary turbines. A condenser recovers exhaust steam from the LP section and a plurality of feedwater heaters preheats condensate collected at the condenser and pumped back to the boiler. The system extracts steam from the HP turbine section for operating the auxiliary turbine. Extracted steam from the auxiliary turbine is isolated from the primary turbine by coupling the steam to a feedwater heater supplied solely from a corresponding extraction point of the auxiliary turbine. The exhaust steam from the auxiliary turbine is coupled directly to the condenser.

3 Claims, 4 Drawing Sheets

BOILER FEEDPUMP TURBINE DRIVE/FEEDWATER TRAIN ARRANGEMENT

BACKGROUND OF THE INVENTION

The present invention relates to steam turbine systems and, more particularly, to an improved turbine cycle arrangement using a turbine drive for a boiler feedwater pump.

In the mid-1950's it was proposed to develop a single turbine drive for the boiler feedwater pump in a steam turbine system in order to improve cycle efficiency. Since that time, a number of boiler feed pump turbine (BFPT) drive/feedwater train arrangements have been implemented. Using a steam turbine to drive the main feedwater pump improves cycle efficiency because of the variable speed capability of the turbine. The initial applications, on single reheat subcritical plants, used cold reheat steam as the energy supply to a non-condensing BFPT. As the concept evolved, the BFPT supplied one or more feedwater heaters and usually exhausted to the deaerator, at which point there was also a connection to the intermediate pressure (IP) exhaust of the main unit. FIG. 1 illustrates a typical prior art arrangement of BFPT 10 in a steam turbine power system 12. The system 12 includes a high pressure (HP) turbine 14 and an intermediate pressure (IP) turbine 16 coupled in driving relationship to an electric power generator 18. A low pressure (LP) turbine 20 is coupled to drive another electric power generator 22. A boiler 24 supplies steam to drive the turbines. A plurality of feedwater heaters 26A–26F utilize steam extracted from the turbines to reheat water collected at condenser 28 and pumped back to boiler 24. At high main unit load, the BFPT exhaust 30 and the main unit IP exhaust 32 share in the steam demand of the deaerator 34. At lower loads, the BFPT exhaust 30 alone supplies the deaerator 34. At still lower loads, there was excess steam at the BFPT exhaust and not only did it supply the deaerator but excess steam was also sent back to the IP exhaust 32. There is a sizable difference in temperature between the BFPT exhaust steam and the IP exhaust steam. In the typical installation illustrated by FIG. 1, the difference in steam temperatures is about 180° F. at maximum load and increases to about 240° F. at 35% load when BFPT steam is sent to the IP exhaust.

In other BFPT applications, the main turbine IP exhaust and the BFPT connect to a common heater at an upstream location in the BFPT. In this instance, the BFPT exhaust and its associated heater "float". In FIG. 2, for example, the tie-in with the main unit (IP exhaust) occurs at heater 26E. The BFPT alone supplies heater 26D and 26F. The difference in steam temperature between the two sources for heater 26E is about 290° F. at maximum load and increases to about 350° F. at 50% load.

Various other arrangements of BFPT's have been tried, including an arrangement on a double reheat turbine where the three lowest pressure heaters, e.g., heaters 26A, 26B and 26C of FIG. 3, receive steam from the BFPT. In such an arrangement, heater 26C is connected to the second blade group exit of the LP turbine as well as the highest pressure extraction point in the BFPT 10. In other systems, non-condensing BFPT arrangements have been superseded by applications in which a straight condensing BFPT is used. In these systems, the BFPT does not supply any feedwater heaters and receives steam from the crossover pipe to the LP turbine.

An example of a condensing BFPT application is shown in FIG. 4. The BFPT 10 receives steam from the IP turbine exhaust and exhausts its steam to the condenser 28.

With the application of double reheat cycles and reheat temperatures above 1000° F., the difference between the extraction steam temperature and the saturation temperature in the feedwater heaters increases considerably as shown in the graphs of FIG. 5. As the temperature difference increases, there is an increase in the loss of available energy during the heat transfer process on cycles which use a condensing BFPT. Of special concern is the high steam temperature at the first extraction point after the second cold reheat. During cycle optimization studies of a 1000 MW double reheat turbine (steam conditions of 4500 psig, 1100° F./1100° F./1100° F.), the steam temperature was 955° F. for the heater supplied from the first extraction point in the IP turbine (after the 2nd reheat). This is about 30° F. higher than the maximum load impulse chamber (first stage exit in the HP turbine) temperature with typical 2400 psig, 1000° F. and 3500 psig, 1000° F. main steam conditions. In addition, the steam temperature at the next two extraction points were 760° F. and 615° F. which are considerably above the temperature where carbon steel extraction piping would be used. So at least two and possibly other extraction steam lines and their respective heaters (shells, tubes and other internals) would require alloy materials. Piping design, to avoid excessive reactions, would also be more complicated and costly.

In a computer simulation, a condensing BFPT system using a double reheat turbine was modified to use a non-condensing BFPT 10A in the manner shown in FIG. 4A. Compared to FIG. 3, the two heaters 26E, 26F that had been supplied by the IP (2nd reheat) turbine 16 are now coupled to the BFPT 10A. The BFPT 10A is also coupled to supply the heater 26D that had been supplied from the LP turbines 20 and exhausted to the next lower pressure heater 26C, which is also coupled to an extraction point on LP turbines 20. The BFPT exhaust flow was greater than this lower pressure heater 26C could condense, so the excess was returned to the first group exit of the LP turbines 20. The temperature of the BFPT exhaust steam was 285° while the LP turbine steam temperature was 450° F. or a difference of 165° F. There was a heat rate improvement of 0.12% with the non-condensing BFPT as compared to the condensing BFPT cycle. This difference also included a decrease in BFPT blading efficiency as compared to the condensing drive. Even if there were no heat rate improvement, the cost savings related to the extraction piping and feedwater heaters would reduce the plant capital cost. In addition, the second reheater size and reheat piping would be reduced because of reduced reheater mass flow. Even with the above discussed modifications, there is a concern about the 165° F. difference in temperature between the steam in the LP turbines and the steam returning from the heater supplied by the BFPT exhaust. Moreover, this difference in temperature would increase as main unit load is reduced. Accordingly, it is desirable to provide a system in which cold BFPT steam will not contact hot LP turbine parts.

SUMMARY OF THE INVENTION

It is an object of the present invention to provide an improved steam turbine system using a boiler feed pump turbine in which cold steam from the feed pump turbine is isolated from hotter portions of a main steam turbine in the system. In accordance with one form of the present invention, a steam turbine system, including a main power generating turbine having at least a high pressure (HP) and a low pressure (LP) turbine stages, is provided with a boiler feedwater pump turbine (BFPT) of a condensing design. Steam is supplied to the BFPT from either an exhaust of a first reheat turbine in the case of a double reheat system or from the exhaust of the HP turbine in the case of a single reheat turbine. The BFPT is coupled at intermediate extraction points to a second and a third lowest temperature feedwater heaters; however, the exhaust of the BFPT is coupled into the system condenser. In this arrangement, there is no direct connection between any of the steam from the BFPT and any part of the main turbines.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENT

Figure 6:
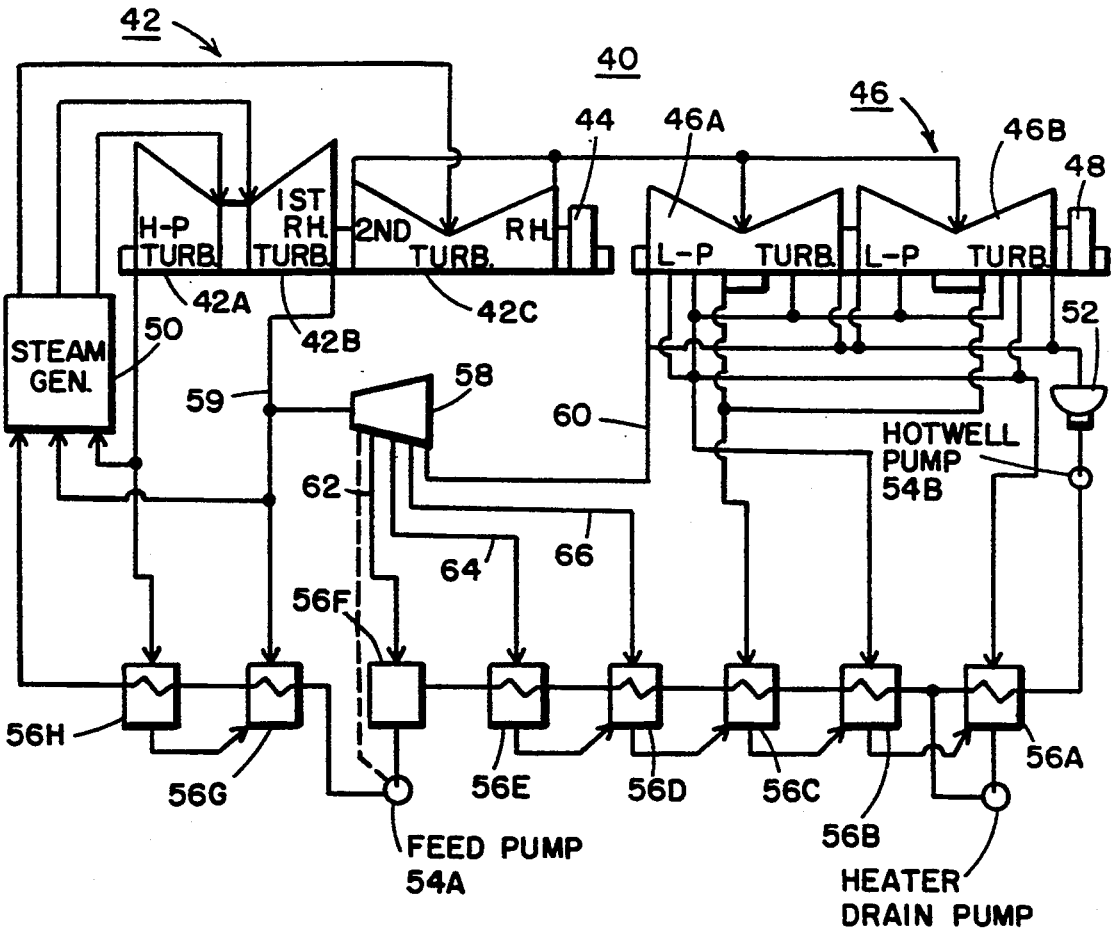
FIG. 6 is a functional representation of a steam turbine cycle arrangement in accordance with the present invention.

Referring to FIG. 6, there is shown a turbine system 40 incorporating the teaching of the present invention. System 40 is a double reheat system including a first primary turbine 42 connected in driving relationship to a first electric power generator 44 and a second primary turbine 46 connected in driving relationship to a second electric power generator 48. Turbine 42 comprises an HP turbine 42A, a first reheat turbine 42B and a second reheat or IP turbine 42C. Turbine 46 comprises a pair of LP turbines 46A and 46B. A steam generator or boiler 50 of an advanced steam condition plant supplies steam at a first pressure and temperature, e.g., 4515 psia and 1100° F., to HP turbine 42A, at a second pressure and temperature, e.g., 1335 psia and 1100° F., to first reheat turbine 42B, and at a third pressure and temperature, e.g., 387 psia and 1100° F., to second reheat turbine 42C. Exhaust steam from turbine 42C is coupled to LP turbines 46A and 46B to affect operation of turbine 46.

Exhaust steam from turbine 46 is coupled into a condenser 52 and the condensate collected at the output of condenser 52 is pumped via pumps 54A–B through a series of feedwater heaters 56A–H back to boiler 50. Each of the feedwater heaters uses steam extracted or exhausted from turbines in the system to raise the condensate or feedwater temperature before it is returned to boiler 50.

The boiler feedpump 54A is driven by direct connection to a boiler feedpump turbine (BFPT) 58. BFPT 58 is coupled to receive steam via piping 59 from the exhaust of the first reheat turbine 42B in the illustrative embodiment although it will be apparent that BFPT 58 could be designed to receive its steam supply from other sources, including direct taps from the cold reheat lines to boiler 50. The exhaust steam from BFPT 58 is dumped directly via piping 60 into condenser 52 and operates as a condensing turbine, i.e., the exhaust is below atmospheric pressure.

As discussed above, the present invention is intended to prevent BFPT 58 exhaust steam from entering the LP turbine 46 and to avoid the penalty associated with mixing steam at significantly different temperatures as well as reducing the temperature difference between the extraction steam and the feedwater in a heater. The present invention achieves these desirable features by changing the turbine cycle arrangement so that exhaust and extraction steam from the BFPT 58 does not mix with different temperature steam from the primary LP turbine 46. In addition to directing BFPT exhaust to the condenser 52, steam extracted from BFPT 58 at intermediate stages (and temperatures) is coupled via piping 62,64,66 to corresponding feedwater heaters such as heaters 56D, 56E and 56F. It will be noted that these heaters receive reheat steam only from BFPT 58 so that there is no mixing of different temperature steam from the LP turbine 46.

Figure 1:
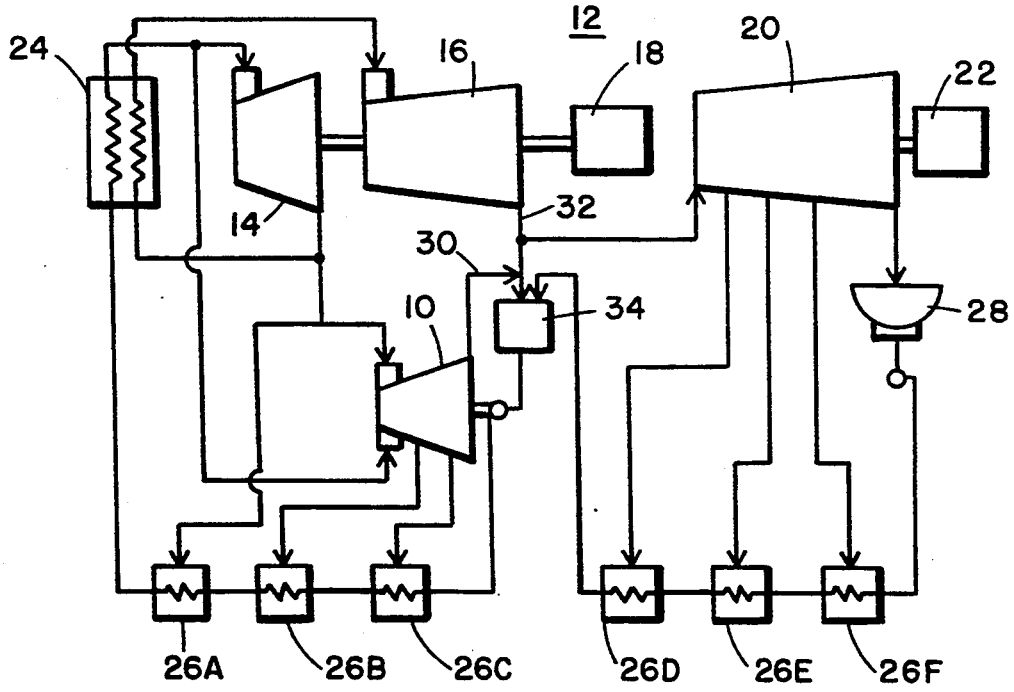
FIG. 1 (PRIOR ART)
FIG. 1 is a simplified functional representation of a prior art steam turbine cycle arrangement using a non-condensing BFPT.
Figure 2:
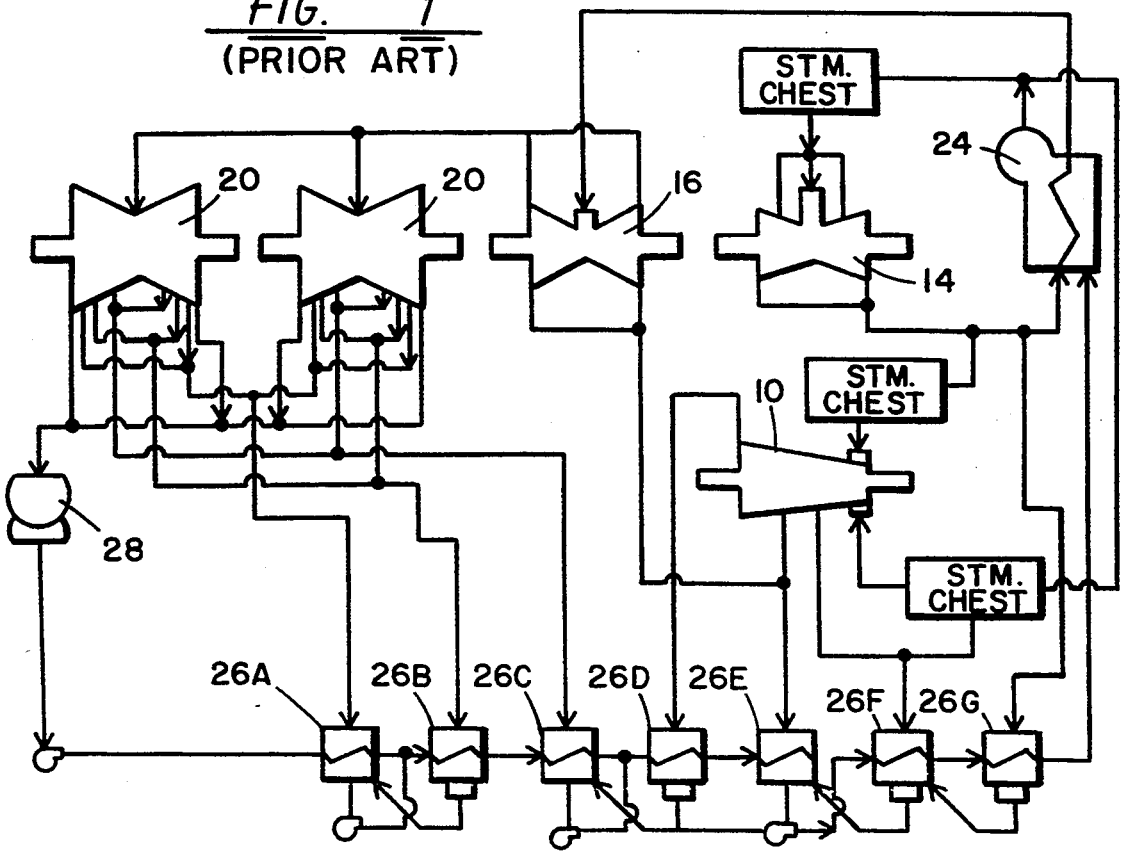
FIG. 2 (PRIOR ART)
FIG. 2 is a simplified functional representation of another prior art steam turbine cycle arrangement using a non-condensing BFPT.
Figure 3:
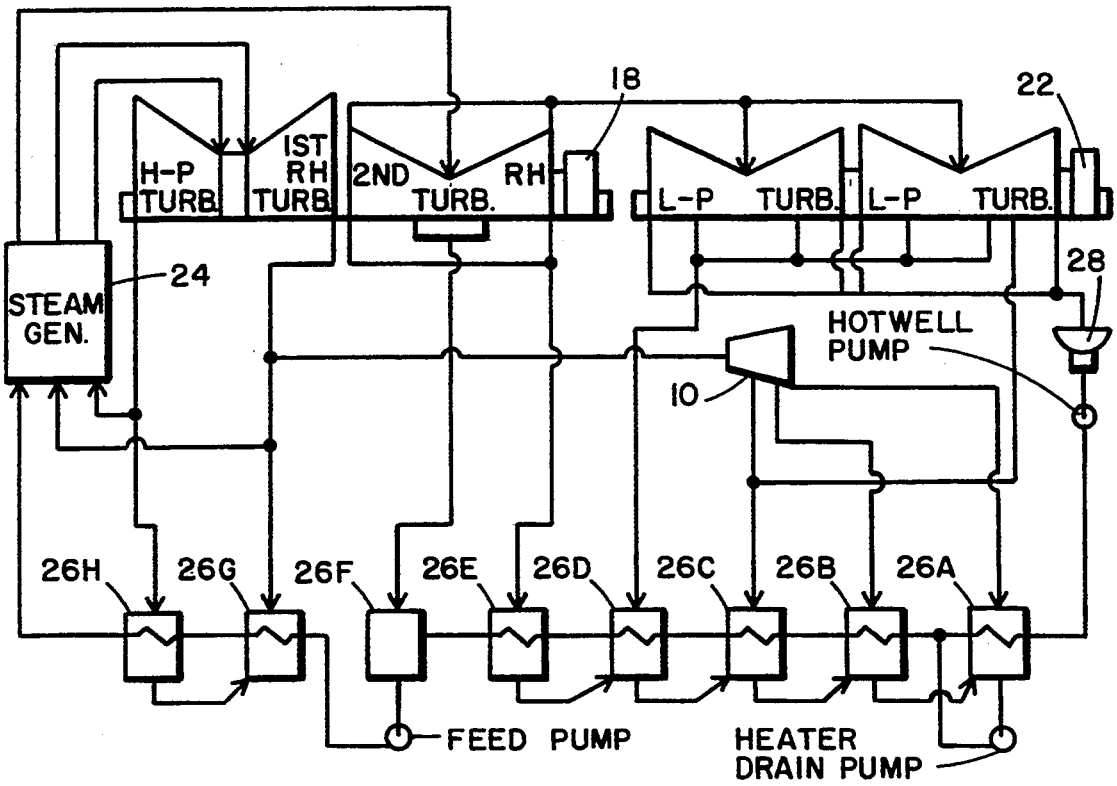
FIG. 3 (PRIOR ART)
FIG. 3 is a simplified functional representation of another prior art steam turbine cycle arrangement using a non-condensing BFPT.

The temperature of steam taken from the intermediate extraction points of BFPT 58 is between the temperature at the first extraction point of the second reheat turbine 46 of FIG. 3 and the temperature at the second extraction point of LP turbine 46, with the temperature at the first extraction point of LP turbine 46 being hotter than the temperature at the extraction points on BFPT 58. The feedwater temperatures increase progressively from heater 56A to heater 56H. Steam from the final extraction point of LP turbine 46 is coupled to heater 56A. Steam extracted from two other intermediate points is coupled to heaters 56B and 56C, respectively. Steam from BFPT 58 is coupled to the next three heaters 56D, 56E and 56F. Heaters 56G and 56H are coupled to receive steam from the exhausts of the primary turbines 42A and 42B as shown.

Figure 4:
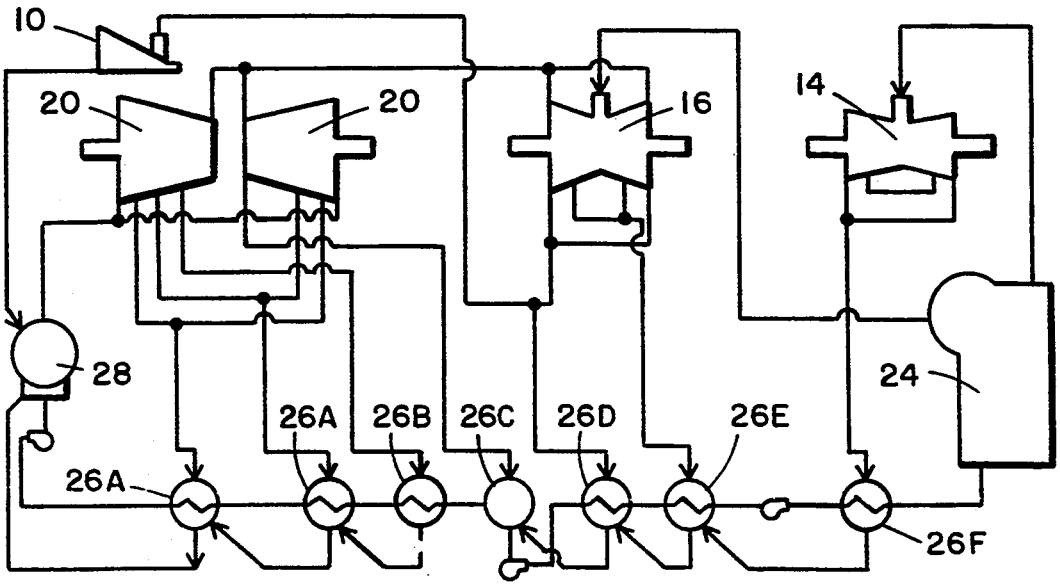
FIG. 4 (PRIOR ART)
FIG. 4 is a simplified functional representation of another prior art steam turbine cycle arrangement using a condensing BFPT.
Figure 4A:
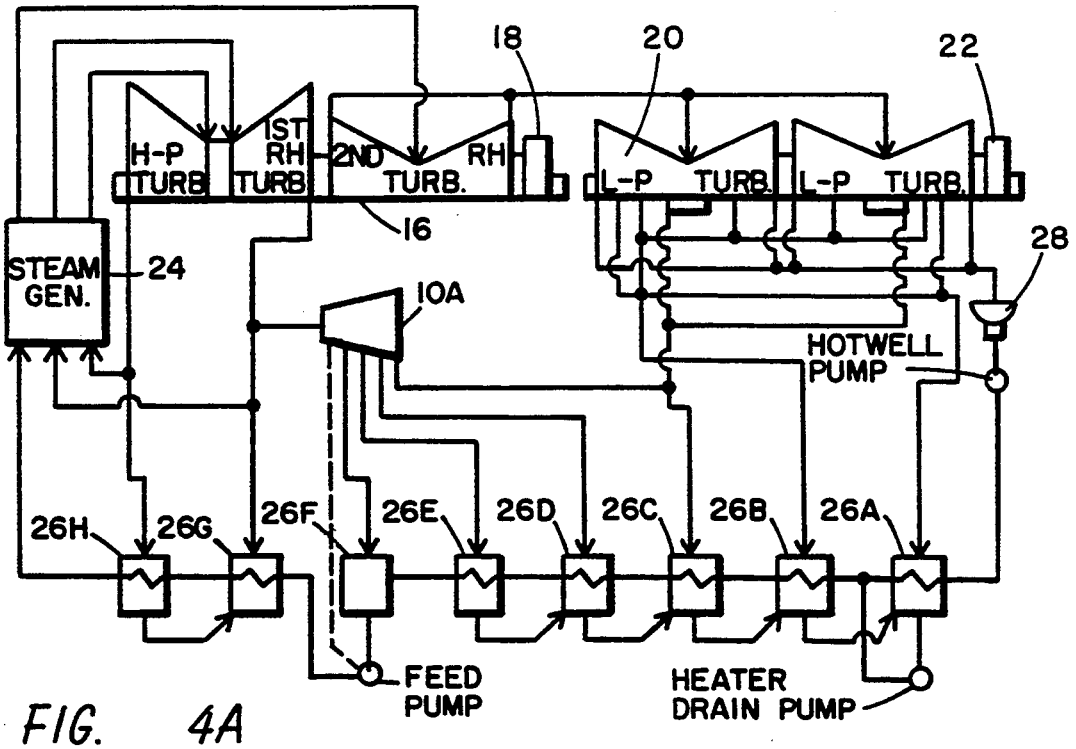
FIG. 4A is a modified form of a double-reheat system in which a condensing BFPT is replaced with a non-condensing BFPT.
Figure 5:
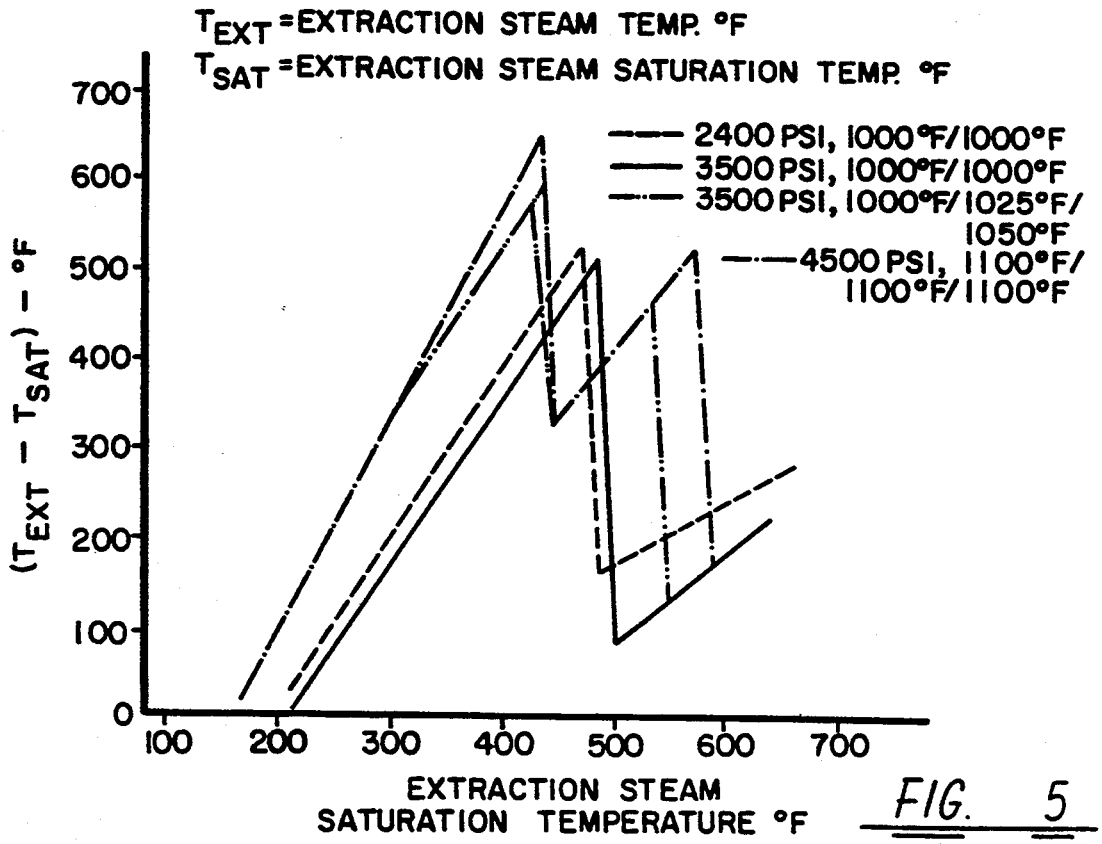
FIG. 5 is a graph of extraction steam temperature as a function of steam saturation temperature.

The cycle arrangement illustrated in FIG. 6 provides a small heat rate improvement while retaining many of the advantages of the straight condensing BFPT (FIG. 4) as well as the advantages of the non-condensing BFPT (FIG. 4A) that supplies steam to feedwater heaters. In addition, conventional carbon steel can be used for all of the extraction piping as compared to alloy piping for the condensing cycle of FIG. 4 and the non-condensing cycle of FIG. 3. The arrangement also simplifies piping and heater design since the extraction steam temperatures are reduced and there is a modest temperature gradient in the heaters. More importantly, the design assures that cool steam does not contact hotter turbine parts as is the case for the non-condensing designs of FIGS. 1, 2 , 3 and 4A.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A steam turbine system comprising: a boiler feedwater pump; an auxiliary turbine for driving the boiler feedwater pump; a primary turbine including a high pressure (HP) section and a low pressure (LP) section; a boiler for supplying steam to drive the primary and auxiliary turbines; a condenser for recovering exhaust steam from the LP section; a plurality of feedwater heaters for preheating condensate collected at the condenser and being pumped back to the boiler by the boiler feedwater pump;

means for extracting steam from the HP turbine section and coupling the extracted steam to the auxiliary turbine for effecting operation of the auxiliary turbine;

means for isolating steam used in the auxiliary turbine from the primary turbine comprising at least one feedwater heater coupled in heat exchange relationship with steam supplied solely from a corresponding extraction point of the auxiliary turbine; and means for coupling exhaust from the auxiliary turbine directly to the condenser.

2. The steam turbine of claim 1 wherein the auxiliary turbine includes a plurality of extraction points and including a corresponding plurality of feedwater heaters each coupled solely to a respective one of the extraction points for receiving steam only from the auxiliary turbine.

3. An improved steam cycle method for a steam turbine system using an auxiliary turbine for driving a boiler feedwater pump, the turbine system including a primary turbine coupled for driving at least one electric power generator, the primary turbine including a high pressure (HP) section and a low pressure (LP) section, a boiler for supplying steam to drive the primary and auxiliary turbines, a condenser for recovering exhaust steam from the LP section and a plurality of feedwater heaters for preheating condensate collected at the condenser and being pumped back to the boiler, comprising the steps of:

coupling the auxiliary turbine into the system in a condensing cycle wherein the auxiliary turbine exhaust is coupled directly to the condenser;

isolating each intermediate extraction point on the auxiliary turbine from steam lines coupled to each of the sections of the primary turbine; and coupling corresponding ones of the feedwater heaters solely to receive steam from the isolated extraction points on the auxiliary turbine.

* * * * *